US007930965B2

(12) United States Patent
Ravid et al.

(10) Patent No.: US 7,930,965 B2
(45) Date of Patent: Apr. 26, 2011

(54) ARMOR

(75) Inventors: Moshe Ravid, Hod Hasharon (IL); Mark Pak, Karmiel (IL); Shmuel Genihovich, Nazareth Ellite (IL)

(73) Assignee: Plasan Sasa Ltd., Marom Hagalil (IL)

( * ) Notice: Subject to any disclaimer, the term of this patent is extended or adjusted under 35 U.S.C. 154(b) by 0 days.

(21) Appl. No.: 11/979,164

(22) Filed: Oct. 31, 2007

(65) Prior Publication Data

US 2008/0223203 A1 Sep. 18, 2008

(30) Foreign Application Priority Data

Nov. 8, 2006 (IL) ..... 179125

(51) Int. Cl.
*F41H 5/02* (2006.01)

(52) U.S. Cl. ..... 89/36.02; 89/917

(58) Field of Classification Search ..... 89/36.02
See application file for complete search history.

(56) References Cited

U.S. PATENT DOCUMENTS

| | | | | | |
|---|---|---|---|---|---|
| 774,959 | A | * | 11/1904 | Tressidder | 148/221 |
| 1,043,416 | A | * | 11/1912 | Giolitti | 148/319 |
| 2,279,110 | A | * | 4/1942 | Collins | 109/82 |
| 3,157,090 | A | * | 11/1964 | Ballu | 89/36.02 |
| 3,566,741 | A | | 3/1971 | Sliney | |
| 3,694,174 | A | * | 9/1972 | Briggs | 428/683 |
| 3,771,418 | A | * | 11/1973 | Gulbierz et al. | 89/36.02 |
| 4,131,053 | A | * | 12/1978 | Ferguson | 89/36.02 |
| 4,489,123 | A | * | 12/1984 | Schijve et al. | 428/213 |
| 4,868,050 | A | * | 9/1989 | Tanaka et al. | 428/335 |
| 5,272,954 | A | * | 12/1993 | Crouch | 89/36.02 |
| 5,290,637 | A | * | 3/1994 | Sliney | 428/548 |
| 5,483,864 | A | * | 1/1996 | Vanark et al. | 89/36.02 |
| 5,749,140 | A | | 5/1998 | Polito et al. | |
| 5,970,843 | A | * | 10/1999 | Strasser et al. | 89/36.02 |
| 6,216,579 | B1 | * | 4/2001 | Boos et al. | 89/36.02 |
| 6,261,398 | B1 | | 7/2001 | Costa | |
| 6,440,257 | B1 | * | 8/2002 | Zhou et al. | 156/307.3 |
| 6,497,966 | B2 | * | 12/2002 | Cohen | 428/626 |
| 2003/0110932 | A1 | * | 6/2003 | Mohr et al. | 89/36.02 |
| 2006/0266207 | A1 | * | 11/2006 | Cerny et al. | 89/36.02 |

FOREIGN PATENT DOCUMENTS

| | | |
|---|---|---|
| CA | 2250659 | 4/2000 |
| FR | 2798185 | 3/2001 |
| GB | 2191147 | 12/1987 |
| WO | 02-055952 | 7/2002 |

* cited by examiner

*Primary Examiner* — Michael Carone
*Assistant Examiner* — Reginald Tillman, Jr.
(74) *Attorney, Agent, or Firm* — The Nath Law Group; Susanne M. Hopkins; William L. Klima

(57) ABSTRACT

A dual hardness armor, comprising a first steel layer of hardness H1 and thickness D1, a second steel layer of hardness H2 lower than H1, and a thickness D2 not greater than D1. The armor further comprises an intermediate substance therebetween bonding the first steel layer to the second steel layer.

30 Claims, 1 Drawing Sheet

ARMOR

FIELD OF THE INVENTION

This invention relates to dual hardness steel armor.

BACKGROUND OF THE INVENTION

Known dual hardness steel armor (DHA) consists of a relatively thin front layer of hard steel facing the expected impact direction of a projectile and a relatively thick back layer of softer steel, and it is known to be highly effective against firearm projectiles due to the differences in the hardness of its layers.

U.S. Pat. No. 5,749,140 discloses a method of producing armor of the kind described above, which involves heat treatment, in which: "... each steel composition would be melted and hot rolled to an intermediate slab thickness" and which involves "peripheral welding to form packs on the front and rear slabs, possibly, but not necessarily, evacuating and hermetically sealing the slabs, thereafter, roll bonding to the desired plate thickness and subsequently heat treating by austenitizing, quenching, and tempering as necessary."

U.S. Pat. No. 5,483,864 discloses another method for producing an armor of the above type, which involves creating a first metal alloy layer, letting it cool down to a semi-liquid state, and then spraying on top of it molten metal alloy to form a second layer. Both layers are then cooled down to form the dual hardness armor.

SUMMARY OF THE INVENTION

According to a first aspect of the present invention, there is provided a dual hardness armor, comprising a first steel layer of hardness H1 and thickness D1 second steel layer of hardness H2 lower than H1, and a thickness D2 not greater than D1, and an intermediate substance therebetween bonding said first steel layer to said second steel layer.

According to a second aspect of the present invention there is provided a dual hardness armor, comprising a first steel layer of hardness H1, second steel layer of hardness H2 lower than H1, and an intermediate substance therebetween bonding said first steel layer to said second steel layer, wherein both H1 and H2 are not lower than 30 Rockwell C.

According to a third aspect of the present invention, there is provided a method for production of a dual hardness armor, including providing a first steel layer of hardness H1 and thickness D1, a second steel layer of hardness H2 lower than H1, and thickness D2 not greater than D1, and bonding of said first steel layer to said second steel layer, using a bonding substance, both layers being, during said bonding, in a solid state.

The method may further include processing each of the steel layers, prior to said bonding, to have desired shape and dimensions, said bonding being performed under such temperature and pressure as not to change said shape and dimensions substantially. Also, said temperature and pressure are such that, they do not affect the chemical and the physical properties of the layers, unless specifically desired, leaving them essentially the same as they were prior to the bonding.

The bonding of the two layers together may be performed under high isostatic pressure (HIP) and elevated temperature using an autoclave machine. When applying this method, said first and said second layer with the bonding substance therebetween are placed in an impermeable bag which is then placed into the autoclave machine. Air is then withdrawn from the bag to near vacuum state, to allow the bonding to be performed within the autoclave under uniform pressure conditions on all sides of the bag.

The first steel layer may be made of UHH steel, which is usually of a hardness of about 60 Rockwell C, and said second steel layer may be made of HH steel, which is usually of hardness about 50 Rockwell C.

The bonding substance may be either a thermoplastic or a thermoset adhesive, and it may also be fiber reinforced. For example, the reinforcement may be provided by a fiberglass net which holds the adhesive, to form a strong bonding layer that has an elongation coefficient greater than 50%. Any adhesive having a high adhesive strength with metal, may be suitable. An example of such an adhesive is a fabric prepreg having an areal weight ranging from 300-750 g/m$^2$ and in which resin constitutes 30-50% of the prepreg. The resin may be any high elasticity elastomeric polymer with elongation greater than 50%. In particular, the prepreg may be an epoxy or polyester based fiberglass prepreg.

In addition, the method may comprise applying a primer coating to at least one of the steel layers, which increases the adhesive strength with said one steel layer, and further applying an adhesive between said primer and the other steel layer. The primer may be suitable to resin and steel surfaces, e.g. it may be Chemlock 205 produced by LORD CORP CHEMICAL PRODUCTS GROUP.

The first steel layer may have a thickness D1 greater than a thickness D2 of the second steel layer. In particular, the ratio D1:D2 may vary according to requirements and specific implementation of said dual hardness armor, and it may particularly be in the range between 1:1 and 9:1. This proves to be advantageous since it allows increasing the thickness of the harder layer, which may thus be more resistant to kinetic energy impacts, with a relatively thin softer layer. This proves to be particularly useful when the harder layer faces in the expected impact direction.

Among other advantages of the present invention, is that the form and dimensions of the layers are not limited to a substantially planar shape as in conventional dual hardness steel armors.

Another advantage of the present invention is that the layers do not need to be heat-treated prior to the bonding process. In known methods of production of a dual hardness armor, steel layers are heat-treated, which may cause the reduction of the flatness of the layers due to thermal stresses within the layers, leading to the formation of air pockets therein during its production. Such air pockets may constitute weak spots in the armor, having lower resistance to incoming projectiles, thus reducing the overall resistance of the armor. The method according to the present invention does not require heat-treatment prior to bonding, due to which high flatness of the layers may be maintained and the formation of air-pockets within the armor may be prevented, or at least essentially reduced.

Due to the unique structure and composition of the above described armor, it may have a surprisingly high ballistic efficiency against high velocity armor piercing projectiles such as for example having the caliber of 5.56 or 7.62 mm. Said armor may further be adapted to be mounted on a vehicle.

In addition, the armor according to the present invention may be fitted with a variety of backing layers.

BRIEF DESCRIPTION OF THE DRAWINGS

In order to understand the invention and to see how it may be carried out in practice, one embodiment will now be described, by way of a non-limiting example only, with reference to the accompanying drawings, in which.

DETAILED DESCRIPTION OF EXEMPLARY EMBODIMENTS

Figure 2:
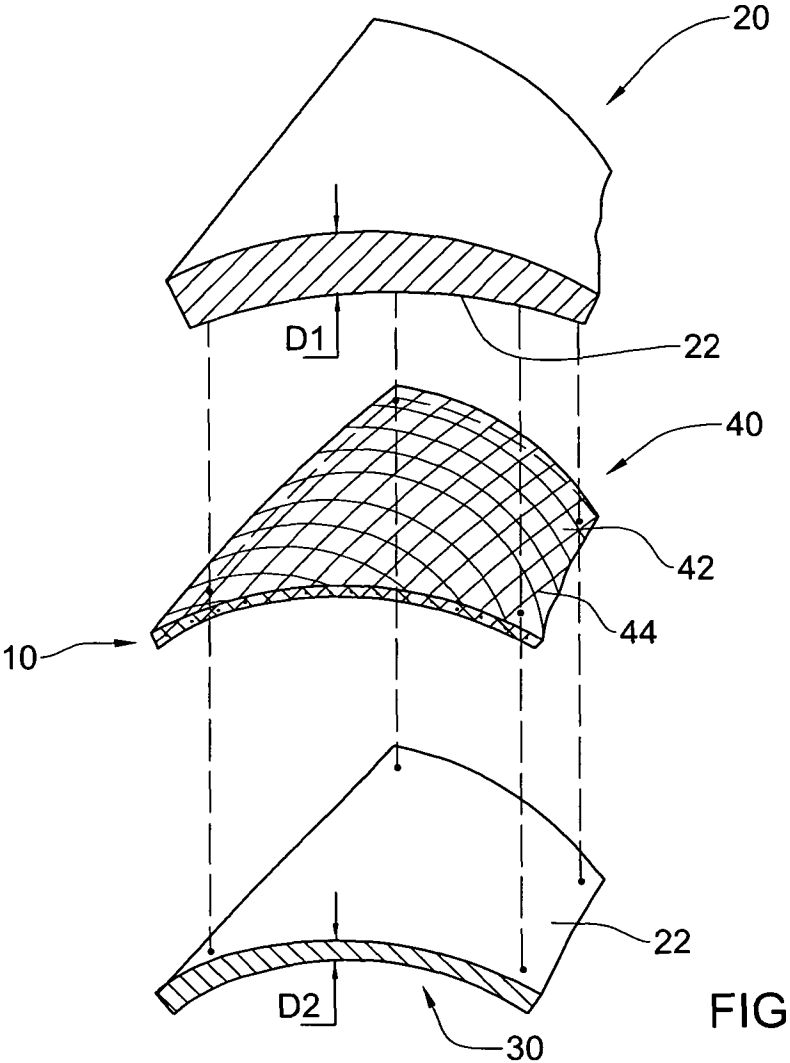
FIG. 2 is a schematic exploded isometric view of a dual harness armor of FIG. 1, prior to the bonding of its layers to each other.
Figure 1:
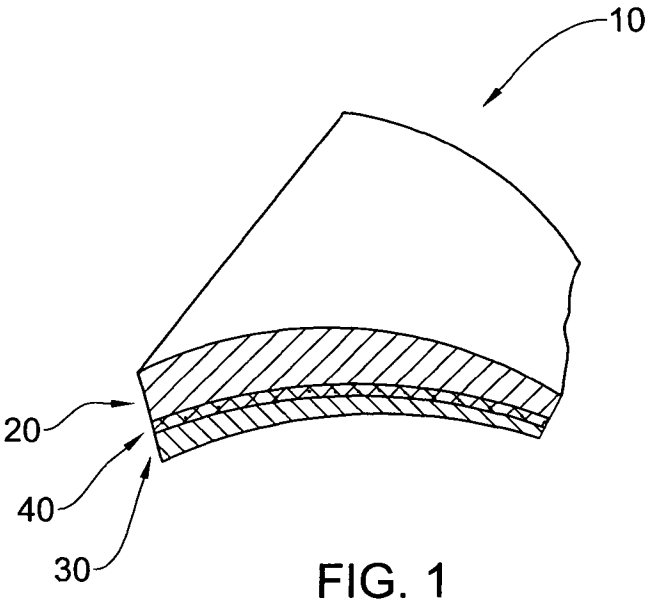
FIG. 1 is a schematic isometric view of a dual hardness armor according to the present invention.

FIGS. 1 and 2 show a dual hardness armor generally designated 10 in accordance with one example of the present invention. The armor comprises a first steel layer 20, a second steel layer 30 and a bonding layer 40 therebetween.

As seen in FIG. 1, the armor 10 and both its steel layers 20 and 30 have a non-planar shape, however this does not necessarily need to be the case. The armor may have any desired shape.

As shown in FIG. 2, the layers 20, 30 are prefabricated to have the desired shape and dimensions, as well as physical and chemical properties. The first steel layer 20 has a thickness D1, and a bonding surface 22. The second steel layer 30 has a thickness D2, and a bonding surface 32. In this example, the first layer 20 is thicker than the second layer 30, i.e. D1 is greater than D2. The first layer 20 is made of UHH steel and is harder than the second layer 30, which is made of HH steel. With reference to FIG. 2, the bonding layer 40 is made of a bonding substance which may be a thermoplastic or a thermoset adhesive, having a solid form at a normal temperature and taking a semi-solid or liquid state under an elevated temperature. The bonding layer 20 may comprise a net of fibers 44 which holds the bonding substance, in order to form a strong fiber-reinforced bonding layer that has an elongation greater than 50%. The fibers 44 may be made of various materials, for example, of fiberglass. In particular, the adhesive may be a fiberglass fabric prepreg having good adhesive strength with metal. Such adhesive may have a fabric areal weight of about 650 g/m$^2$ and 35% resin. The resin may be any high elasticity elastomeric polymer, e.g. Polyester, Polyurethane or rubber based resin, with elongation coefficient greater than 50%.

The dual hardness armor 10 is produced by pressing, under elevated temperature, the first hard UHH steel layer 20, and the second softer HH steel layer 30 with the bonding layer 40 therebetween, in an autoclave machine (not shown), More particularly, the layers and bonding layer 40 are placed in an impermeable bag (also not shown) and the bag is placed within the autoclave. The pressure within the bag is then reduced by way of removal of air therefrom, resulting in a pressure difference between the inside of the bag and the interior of the autoclave. This pressure difference creates essentially uniform force acting on the bag on all sides. The pressure within the Autoclave is further raised to provide high pressure for the process, for example, it may be between 2-20 Kg/cm$^2$.

During this process, due to the pressure and temperature conditions, the bonding layer 40, transforms into an intermediate bonding film of fairly uniform thickness, which adheres to the steel layers 20, 30 thereby bonding them one another. It is important to note here that these pressure and temperature conditions are such that allow the bonding layer 40, to transform into the bonding film, but at the same time, do not affect the chemical and/or physical properties of the steel layers 20, 30, nor their shape and dimensions, if this is not intended.

Reverting to FIG. 1, the dual hardness armor 10 is schematically shown in its final state. The first layer 20 and the second layer 30 are firmly bonded together by the bonding layer 40. The shape and dimensions of the armor are virtually identical to those of each of the layers 20, 30 prior to the bonding. Furthermore, due to the uniqueness of this method, the chemical and physical properties of the layers 20, 30 of which the dual hardness armor 10 is made, are identical to those of the layers 20, 30, prior to the bonding.

In tests carried out on samples of dimensions 250×300 mm, having a first hard layer made of UHH steel having the thickness of 6.3 mm, and a second softer layer thinner than the first steel layer, having a thickness in the range of 3-6 mm, the armor was able to withstand 30.06 armor piercing projectiles, 20 mm FSP (fragment simulating projectile), and more than 50 rounds of 7.62 armor piercing bullets, depending on the thickness of the second layer and whether or not a backing material, such as Kevlar®, for example, was used. The weight of all samples ranged from 6.2 kg to about 9 kg.

Those skilled in the art to which this invention pertains will readily appreciate that numerous changes, variations, and modifications can be made without departing from the scope of the invention, *mutatis mutandis*.

The invention claimed is:

1. A dual hardness armor, comprising a first steel layer of hardness H1 and thickness D1, a second steel layer of hardness H2 less than H1 and a thickness D2 equal to or less than D1, and an intermediate substance therebetween bonding said first steel layer to said second steel layer, wherein said intermediate substance is an adhesive in the form of a fiber reinforced prepreg comprising resin made of an elastomeric polymer having an elongation coefficient which is equal to or greater than 50%.

2. The dual hardness armor according to claim 1, wherein said prepreg is fiber reinforced by a fiberglass net having an areal weight ranging from 300-750 g/m$^2$.

3. The dual hardness armor according to claim 1, wherein said intermediate substance has an elongation coefficient of at least 50%.

4. The dual hardness armor according to claim 1, wherein a weight of said resin constitutes 30-50% of the weight of the prepreg.

5. The dual hardness armor according to claim 1, wherein both said first steel layer and said second steel layer have a hardness which is no less than 30 Rockwell C.

6. The dual hardness armor according to claim 1, wherein the thickness ratio D1:D2 is in the range of 1:1 to 9:1.

7. The dual hardness armor according to claim 1, wherein said first steel layer is made of Ultra High Hardness (UHH) steel, and said second steel layer is made of High Hardness (HH) steel.

8. A method for production of a dual hardness armor, comprising:

providing a first steel layer of hardness H1 and thickness D1, a second steel layer of hardness H2 less than H1, and thickness D2 not greater than D1; and bonding of said first steel layer to said second steel layer, using a bonding substance in the form of a fiber reinforced prepreg including resin made of an elastomeric polymer having an elongation coefficient equal to or greater than 50%, wherein both layers are, during said bonding, in a solid state.

9. The method according to claim 8, wherein said prepreg is fiber reinforced by a fiberglass net having an areal weight ranging from 300-750 g/m$^2$.

10. The method according to claim 8, wherein said bonding substance has an elongation coefficient of at least 50%.

11. The method according to claim 8, wherein said resin's weight comprises 30-50% of the weight of the prepreg.

12. The method according to claim 8, wherein both said first steel layer and said second steel layer have a hardness which is no less than 30 Rockwell C.

13. The method according to claim 8, wherein a ratio of thickness of D1 to D2 is in a range of 1:1 to 9:1.

14. The method according to claim 8, wherein said first steel layer and said second steel layer are provided for bonding when prefabricated to their final shape and dimensions.

15. The method according to claim 8, wherein bonding is performed such that said first steel layer and said second steel layer maintain their chemical and physical properties after said bonding as prior to said bonding.

16. A dual hardness armor comprising:

a first UHH steel layer of hardness H1 and thickness D1;

a second steel layer of hardness H2 less than H1 and a thickness D2 equal to or less than D1; and an intermediate substance therebetween bonding said first steel layer to said second steel layer, wherein said intermediate substance is an adhesive in the form of a fiber reinforced prepreg comprising resin made of an elastomeric polymer having an elongation coefficient which is equal to or greater than 50%.

17. The dual hardness armor according to claim 16, wherein said prepreg is fiber reinforced by a fiberglass net having an areal weight ranging from 300-750 g/m$^2$.

18. The dual hardness armor according to claim 16, wherein said intermediate substance has an elongation coefficient of at least 50%.

19. The dual hardness armor according to claim 16, wherein a weight of said resin constitutes 30-50% of the weight of the prepreg.

20. The dual hardness armor according to claim 16, wherein a ratio of thickness of D1 to D2 is in a range of 1:1 to 9:1.

21. A dual hardness armor comprising:

a first steel layer of hardness H1 of about 60 Rockwell C and thickness D1;

a second steel layer of hardness H2 less than H1 and a thickness D2 equal to or less than D1; and an intermediate substance therebetween bonding said first steel layer to said second steel layer, wherein said intermediate substance is an adhesive in the form of a fiber reinforced prepreg comprising resin made of an elastomeric polymer having an elongation coefficient which is equal to or greater than 50%.

22. The dual hardness armor according to claim 21, wherein said prepreg is fiber reinforced by a fiberglass net having an areal weight ranging from 300-750 g/m$^2$.

23. The dual hardness armor according to claim 21, wherein said intermediate substance has an elongation coefficient of at least 50%.

24. The dual hardness armor according to claim 21, wherein a weight of said resin comprises 30-50% of the weight of the prepreg.

25. The dual hardness armor according to claim 21, wherein a ratio of thickness of D1 to D2 is in a range of 1:1 to 9:1.

26. A dual hardness armor comprising:

a first steel layer of hardness H1 and thickness D1;

a second steel layer of hardness H2 of about 50 Rockwell C, which is less than H1, and a thickness D2 equal to or less than D1; and an intermediate substance therebetween bonding said first steel layer to said second steel layer, wherein said intermediate substance is an adhesive in the form of a fiber reinforced prepreg comprising resin made of an elastomeric polymer having an elongation coefficient which is equal to or greater than 50%.

27. The dual hardness armor according to claim 26, wherein said prepreg is fiber reinforced by a fiberglass net having an areal weight ranging from 300-750 g/m$^2$.

28. The dual hardness armor according to claim 26, wherein said intermediate substance has an elongation coefficient of at least 50%.

29. The dual hardness armor according to claim 26, wherein a weight of said resin comprises 30-50% of a weight of the prepreg.

30. The dual hardness armor according to claim 26, wherein a ratio of thickness of D1 to D2 is in a range of 1:1 to 9:1.

* * * * *